US007306476B2

(12) United States Patent
Gerlich et al.

(10) Patent No.: US 7,306,476 B2
(45) Date of Patent: Dec. 11, 2007

(54) CONTACT DEVICE FOR THE ELECTRIC CONTACT OF CABLE SHIELDS

(75) Inventors: Walter Gerlich, Augsburg (DE); Roland Plabst, Alling (DE); Carsten Siebold, Gilching (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/518,309

(22) PCT Filed: May 7, 2003

(86) PCT No.: PCT/EP03/04761

§ 371 (c)(1),
(2), (4) Date: Dec. 16, 2004

(87) PCT Pub. No.: WO2004/004073

PCT Pub. Date: Jan. 8, 2004

(65) Prior Publication Data

US 2005/0233642 A1 Oct. 20, 2005

(30) Foreign Application Priority Data

Jun. 27, 2002 (DE) ..... 102 28 754

(51) Int. Cl.
*H01R 4/24* (2006.01)
*H01R 4/26* (2006.01)
*H01R 11/20* (2006.01)

(52) U.S. Cl. ..... 439/394; 439/98

(58) Field of Classification Search ..... 439/585, 439/394, 391, 397, 401, 420, 95, 424–425, 439/434, 435, 411, 886, 410, 98, 610, 579; 248/74.1–74.5; 24/23 R, 20 CW, 20 R
See application file for complete search history.

(56) References Cited

U.S. PATENT DOCUMENTS

| | | | | |
|---|---|---|---|---|
| 2,423,627 | A * | 7/1947 | Tinnerman | 439/424 |
| 3,452,318 | A | 6/1969 | Tanges, Jr. | |
| 4,169,646 | A * | 10/1979 | Stape et al. | 439/397 |
| 4,325,598 | A * | 4/1982 | Leonardo | 439/98 |
| 4,696,908 | A | 9/1987 | Gutter et al. | |
| 4,875,864 | A | 10/1989 | Campbell | |
| H968 | H * | 10/1991 | Moyles | 248/74.5 |
| 5,636,306 | A | 6/1997 | Mock et al. | |
| 6,202,300 | B1 * | 3/2001 | Yuzwalk | 439/813 |
| 2003/0175550 | A1 * | 9/2003 | Rumbach et al. | 428/675 |

FOREIGN PATENT DOCUMENTS

| | | |
|---|---|---|
| DE | 1 515 404 | 12/1969 |
| DE | 90 04 554 U1 | 8/1990 |
| DE | 197 34 818 C2 | 3/1998 |
| DE | 197 43 353 A1 | 9/1998 |
| DE | 299 23 342 U1 | 10/2000 |
| GB | 2 232 020 A | 11/1990 |

* cited by examiner

*Primary Examiner*—Felix O. Figueroa

(57) ABSTRACT

Contact device for electrical cable with a cable shield including an arc-shaped contact part (3) that can be secured around the sheath of a cable and is provided with contact elements that protrude in a radially inward manner. Each contact element extends to form a point such that during installation in a direction of impact that is oriented inwards and in an essentially radial manner, the point penetrates the cable sheath and produces an electrical contact with the cable shield.

16 Claims, 4 Drawing Sheets

CONTACT DEVICE FOR THE ELECTRIC CONTACT OF CABLE SHIELDS

CROSS REFERENCE TO RELATED APPLICATIONS

This application is the US National Stage of International Application No. PCT/EP2003/004761, filed May 7, 2003 and claims the benefit thereof. The International Application claims the benefits of German application No. 10228754.6 filed Jun. 27, 2002, both applications are incorporated by reference herein in their entirety.

FIELD OF THE INVENTION

The invention relates to a contact device for electric cables that has a shield that comprises an arc-shaped contact part that can be secured around the sheath of the cable and has contact elements that protrude in a radially inward manner.

BACKGROUND OF THE INVENTION

To produce a contact with the shield of an electrical cable and create a link to the ground potential of the casing, it is usual to remove the insulation along a section of the cable and secure the exposed shield to a casing part using an electrically conductive cable clip or cable clamp. The cable sheath is usually removed manually. This is time consuming and brings with it the risk that the insulation of the single cores under the cable sheath may be damaged. In addition to producing a contact with the shield of a cable, strain relief is often required for the cable at the same time. But with a stripped cable, the strain is transferred via the clamp of the shield directly to the cable wires. The single cores can however only absorb low mechanical forces.

A variety of devices are known for producing an electrical contact and fixing an electrical cable. From DE 19743353 an arrangement for producing electrical contact of cable shields is known in which a U-shaped contact body mounted on the cable to be contacted. The electrical contact with the cable shield is produced through blade-like edges that are arranged on the inside of the U-shaped legs. When the contact body is attached, or if tensile forces are applied to the cable in the assembled state, the blade edges may not only cut through the cable sheath but also through the braid of the cable shield and damage the underlying insulation of the single cores.

A ground terminal for fiber optic cable is known from U.S. Pat. No. 5,636,306. The ground terminal comprises a frame section connected to a ground wire and pairs of opposing grip elements that are part of the frame section. When installed, the grip elements form an opening into which a fiber optic cable can be threaded. Each grip element is provided with radially inward facing teeth which when fixed are pressed onto the metallic sheathing of the fiber optic cable by a clamp. This produces an electrical contact with the ground wire. Any devices connected to the fiber optic cable are protected by the ground from electrical discharges and lightning strikes. The disadvantage is that the contact equipment comprises a plurality of individual components and is therefore costly to manufacture.

A plastic cable clip to fix cable to a wall or support is known from DE 197 34 818 C2 in which the cable is placed in a U-shaped component and held by inward-facing curved projections.

SUMMARY OF THE INVENTION

The object of the present invention is to create a contact device for electrical cables that does not strip the insulation, provides both reliable contact and strain relief and is suitable for manufacture in large quantities.

According to the present invention the object is achieved by the claims.

According to the present invention, the contact device has contact elements which are embodied such that each extends to form a point such that during installation of said contact device in a direction of impact which is oriented inwards and in an essentially radial manner, said points penetrate the cable sheath and produce an electrical contact with the cable shield.

The invention is based on the knowledge that it is beneficial for producing a reliable contact and strain relief if the cable sheath is penetrated by the contact elements and not as in the prior art cut through by blades. This reduces the risk of damaging the insulation of the underlying single cores. The protective cable sheath is only breached where the contact elements penetrate. In the area of penetration, the cable sheath forms a seal around the contract elements. This seal ensures that each contact element is better protected from air and moisture penetrating from outside. This protection reduces the formation of oxide layers between the contact surfaces. For devices in communications technology that often have a minimum life expectancy of several years, this reliable ground connection for the cable shield that is stable over the long-term is very beneficial. In particular, if such devices are operated in harsh environments with temperature fluctuations and if the contact points are subject to mechanical stresses, the present invention can maintain contact resistance at a uniform low level throughout the entire period of usage.

The contact device according to the present invention is simple to use. It is clamped around the cable sheath and for example secured to a plate using a bolt fixing. During installation the electrical contract and the mechanical strain relief is produced simultaneously. Since the sheath is punctured and not cut, the risk of accidentally damaging the insulation of the single cores surrounded by the shield when making contact with the said shield is reduced. Costly removal of the cable sheath is no longer required. The contact device in accordance with the present invention can be set up in a relatively shorter period of time.

Both the form and the arrangement of the contact elements may vary. The contact elements can for example be formed from spheres or pyramids that extend to form a point. In the contact area, there may be a plurality of axially spaced rows of contact elements. The only important criterion is that the cable sheath is punctured and not cut such that the remaining area of sheath between the contact elements is not damaged. The strain relief is in the cable sheath and is flexible. In the area of penetration, the effect of the seal is retained due to elastic pre-tensioning even if mechanical stresses act on the cable. In the fixed state, the points of the contact elements remain radially spaced with respect to the single cores. This means the insulation properties of the single cores are not compromised when mechanical tensile forces act on the cable with a radial force component.

It is particularly beneficial if the contact elements of the fixed contact part penetrate the cable sheath such that the electrical contact is produced in an essentially concentric area in the cable. This means that the electrical contact and the mechanical strain relief are distributed evenly across a plurality of contact elements. Both effects remain reliable even in harsh environments.

In a simple embodiment of the present invention, the contact part is formed as a cable clip and the contact elements are designed as teeth on a tooth ring.

Ideally, the fixed cable clip is centered by stops arranged radially on the inside between the teeth. The stops limit the penetration depth of the contact elements. There is no oval deformation of the cable cross-section with the result that there is no irregular depth penetration of the contact elements. It is particularly beneficial for a cable where the sheath is made from a comparably soft plastic and the shield is made from an easily penetrated twisted thin foil or from a thin metal braid.

For manufacturing in large quantities, it is ideal if the cable clip is made from a punched and shaped component and the teeth from edges of a sheet section bent radially inward. It is beneficial if the teeth are triangular and the points are arranged at equal distances apart.

It is beneficial if the teeth are appropriate to the thickness of the sheath. This is achieved in an embodiment in which the height of the individual teeth is smaller than or equal to the combined thickness of the cable sheath and the cable shield. This ensures that the insulation of the single cores is not damaged.

For this, a radial stop can be simply manufactured in which the teeth are arranged on the peripheral side over gaps. The stop may also for example be manufactured from lugs pointing radially inward.

From a technical manufacturing viewpoint, it is ideal if the contact part and all the teeth are made from one piece and from the same material, namely metal.

Oxidation of the contact elements can be cost-effectively prevented by adding a coating of corrosion-resistant material, preferably tin. It may also be beneficial if the contact part is made from a corrosion-resistant material.

The mechanical fixing of the contact device may be improved through stiffeners which may for example take the form of beading or ribbing. This is particularly beneficial if the contact device according to the present invention is used in an electrical device that is subjected to violent vibration during operation. Since in addition to the contact being produced, strain relief is also provided, additional clamps and cable clips are not required. Of course, several contact devices can be provided for a cable. The device can be secured to a plate using a bolt fixing which provides a cost-effective, robust and reliable ground connection between the cable shield and the casing that is stable over the long term.

If during operation the electrical cable is subjected to strong tensile forces and harsh environmental conditions, it may be beneficial if the contact part is overmolded 20 with a polymer or elastomer material except for the contact surfaces. By coating the sharp edges of the punched part with a rubber material, the risk of damaging the cable sheath near the clamping point is reduced. The mechanical vibrations near the clamping point will also be attenuated to some extent. This damping property is particularly desirable if the cable is fixed to a backplane that can only tolerate limited mechanical vibrations in continuous operation. The overmolding also provides corrosion protection against outside.

Preferably, the contact device according to the present invention is installed in electrical devices, in particular in telecommunication systems. In switching systems and exchanges, a plurality of cables often has to be reliably connected to the ground potential of a module frame. Such devices not only have high shielding requirements but the resistance of the ground potential must also be maintained at a uniformly low level over a comparably long operating period.

BRIEF DESCRIPTION OF THE DRAWINGS

A further explanation of the invention is now given with reference to the drawings that show schematically two different embodiments according to the present invention: The drawings.

DETAILED DESCRIPTION OF THE INVENTION

The drawings of the FIGS. 2 to 6 show possible embodiments of the contact device in accordance with the present invention.

Figure 1:
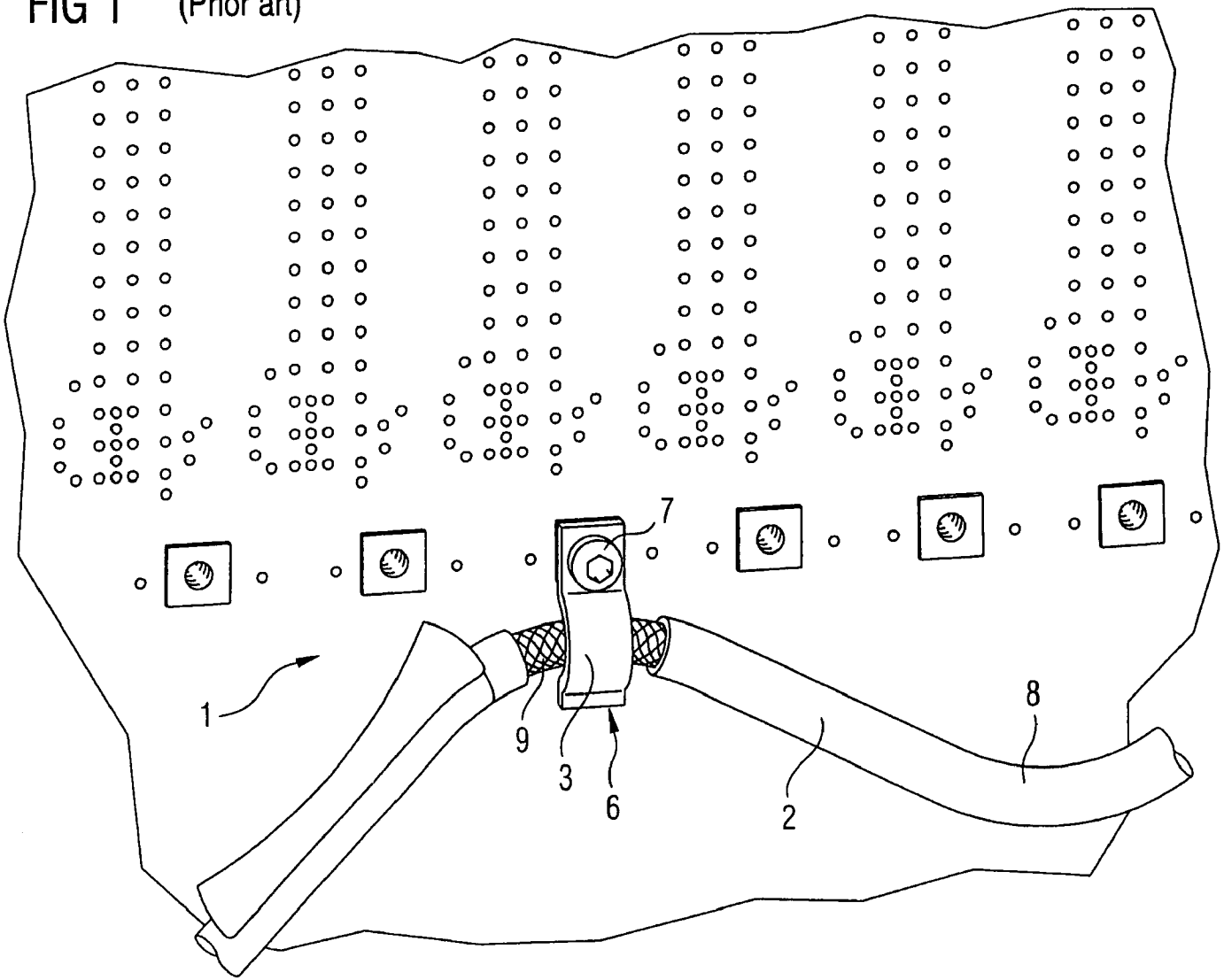
FIG 1 (Prior art)
FIG. 1 shows a perspective view of a known contact device for an electrical cable

FIG. 1 shows a perspective view of a known contact device 1 for an electric cable 2 such as is usually used in telecommunications systems. In FIG. 1, cable 2 connects an external main distribution frame (not shown) to a plurality of modules that are connected via a backplane and arranged in a housing. Such a cable usually comprises insulated single cores that are twisted and surrounded by a common shield 9, such as a twisted aluminum foil or a metal braid. Shield 9 lies directly around the single cores. On the outside, cable 2 is protected by a plastic sheath 8 that is usually manufactured from PVC or rubber. Cable shield 9 prevents the spread of electromagnetic interference to the single cores. To create a ground contact, the cable sheath 8 is stripped at a point. This stripping is usually carried out manually. Cable sheath 8 is opened and removed in a contact area. This releases the shield 9 of the cable 2. A cable clip 6 is clamped around the foil or braid of the shield 9 and electrically connected using a bolt fixing 7 to the backplane of the device.

Figure 2:
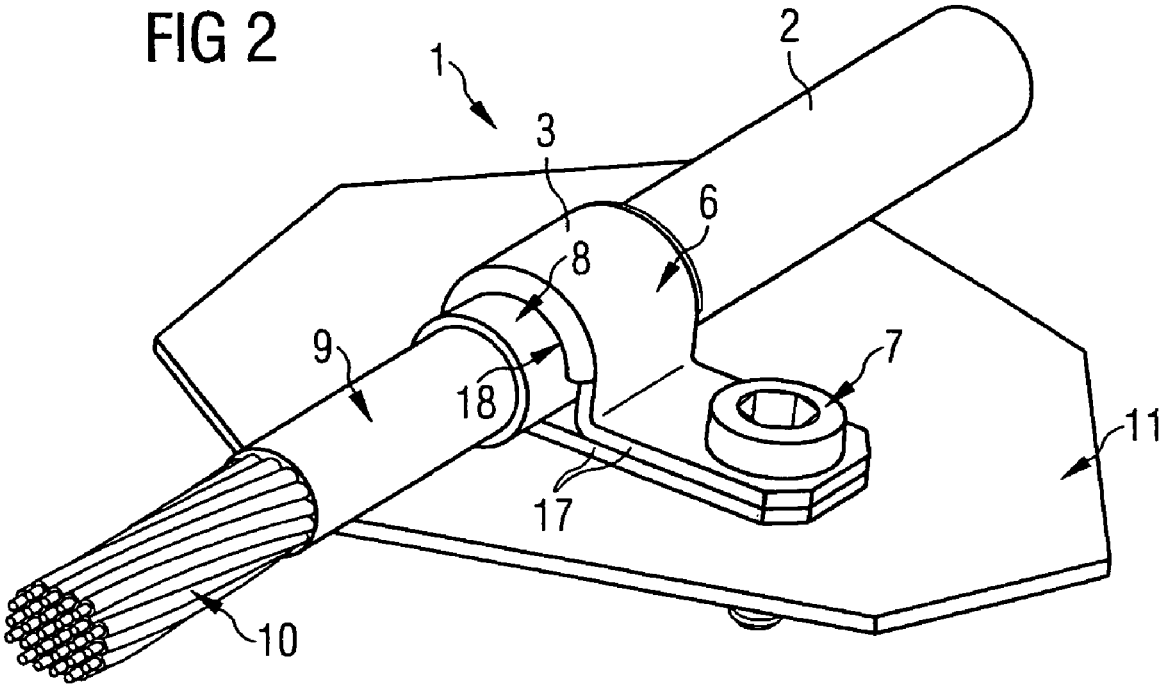
FIG. 2 shows a perspective view of a first embodiment of the invention.

FIG. 2 shows a perspective view of a first embodiment of the invention. The diagram shows the contact device 1 in the mounted state. Contact part 3 is designed as a cable clamp 6. The contact elements 5, that are not visible in FIG. 2, penetrate the sheath 8 of the cable 2 in a direction of impact that is oriented inwards and in an essentially radial manner and produce an electrical contact with the shield 9. The cable sheath does not need to be stripped. The cable clamp 6 is clamped and secured around the sheaths. It is fixed to plate 11 using a bolt fixing 7. This produces not only contact with the shield, but also strain relief for the cable. The positioning of the base 17 and stops 18 ensure that the insulation of the single cores 10 remains undamaged.

Figure 3:
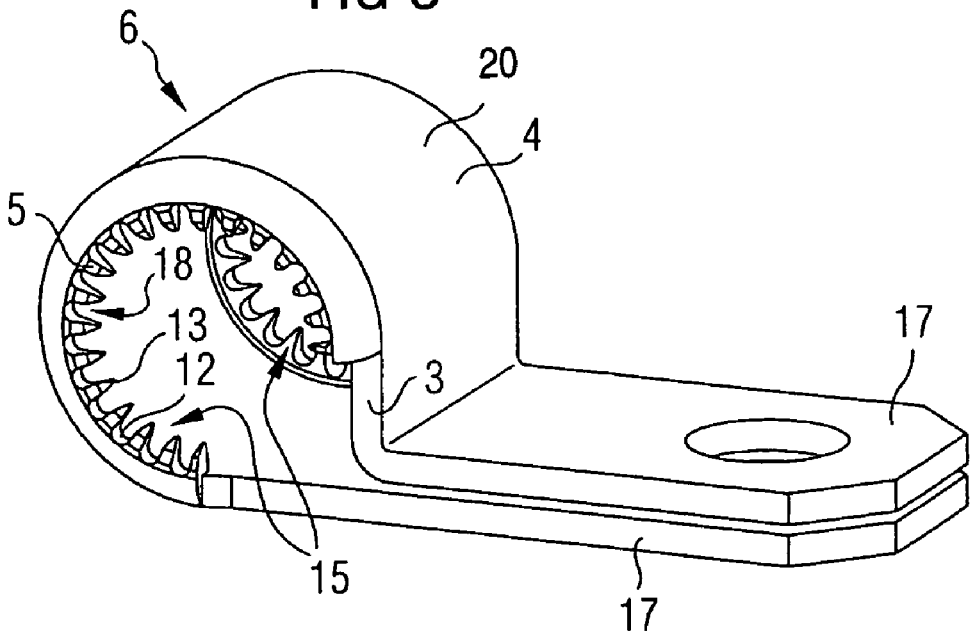
FIG. 3 shows a perspective view of a cable clamp with a cutting tooth ring designed into each end.

FIG. 3 shows the cable clamp 6 in an uninstalled state without the cable. On the end faces of the cable clamp 6, the edges are punched out as claws.

In the area of curved section 4, these claw-like punchings are bent and oriented radially inwards. They form the contact elements 5. In the embodiment shown, they are deigned as a cutting tooth ring 15. The points 13 of the teeth 12 are formed by stamping a punch sheet. The ends of the contact part 3 feed into a base 17 that has a drill hole through which the cable clamp 6 can be fixed using a bolt fixing.

Figure 4:
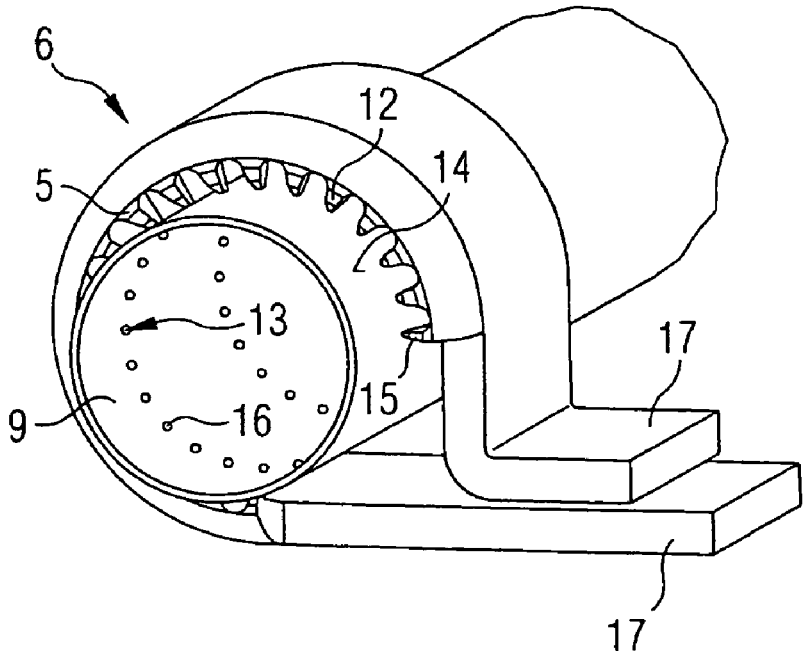
FIG. 4 shows a perspective view of a cable clamp in an embodiment in which the points of the tooth ring touch a concentric contact area.

As can be seen in FIG. 4, the points 13 of the teeth 12 of the tooth ring 15 end on a surface 14 of the shield 9. In their radial inward extension, the contact elements 5 are embodied such that they touch the shield 9 or lightly penetrate it. In the contact points 16, shield 9 touches or envelops the points 13 of teeth 12. Since the contact is distributed across a plurality of points and each of these points is sealed from the outer area, a reliable electrical contact is produced that is stable over the long term between the cable clamp 6 and the shield 9.

Figure 5:
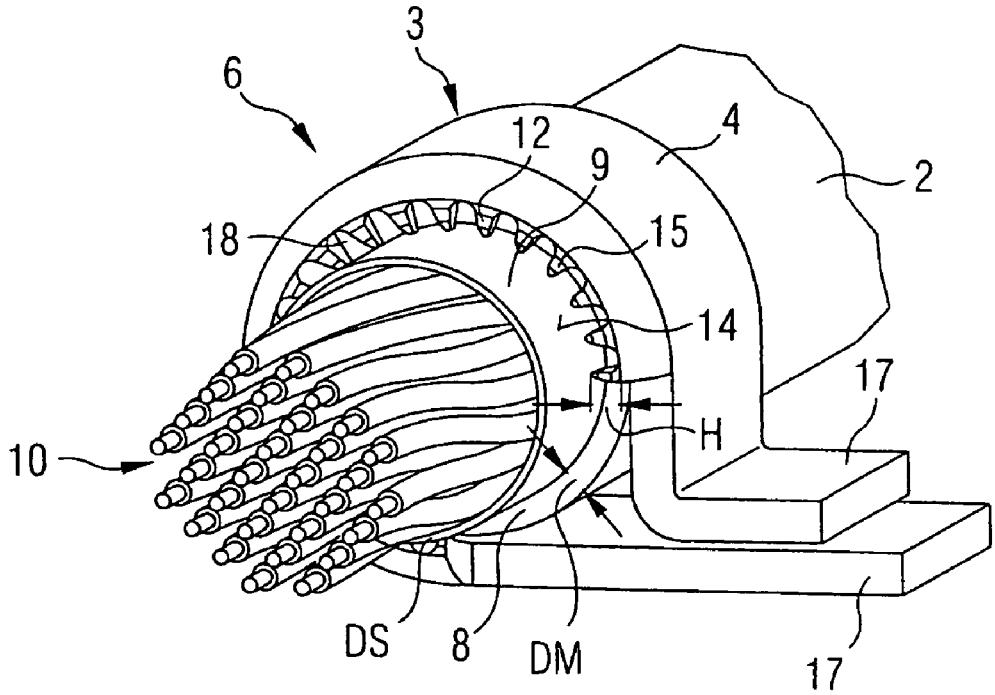
FIG. 5 shows a perspective view of a cable clamp which is clamped around an electric cable and which is shown partially as a cross-section.

FIG. 5 shows a perspective view of a cable clamp 6 with single cores 10 visible. The teeth 12 of the front tooth ring 15 are visible in the partial cross-section. The height of the tooth 12 is labeled H. The cable sheath has a thickness DM. The shield thickness is labeled DS. As can be seen from the diagram, the teeth 12 are arranged over gaps. Each gap between two teeth 12 forms a stop 18 in the base area. When attaching the contact device, these steps 18 provide a centering function. This ensures that the circular cross-section of the cable 2 is not deformed into an oval when the cable clamp 6 is fixed. If the tooth height H of a tooth 12 is smaller than or equal to the overall thickness D, comprising the sheath thickness DM and the shield thickness DS, i.e. D is smaller than or equal to DM+DS, then the insulation of the single cores will not be damaged by the shield contact.

Figure 6:
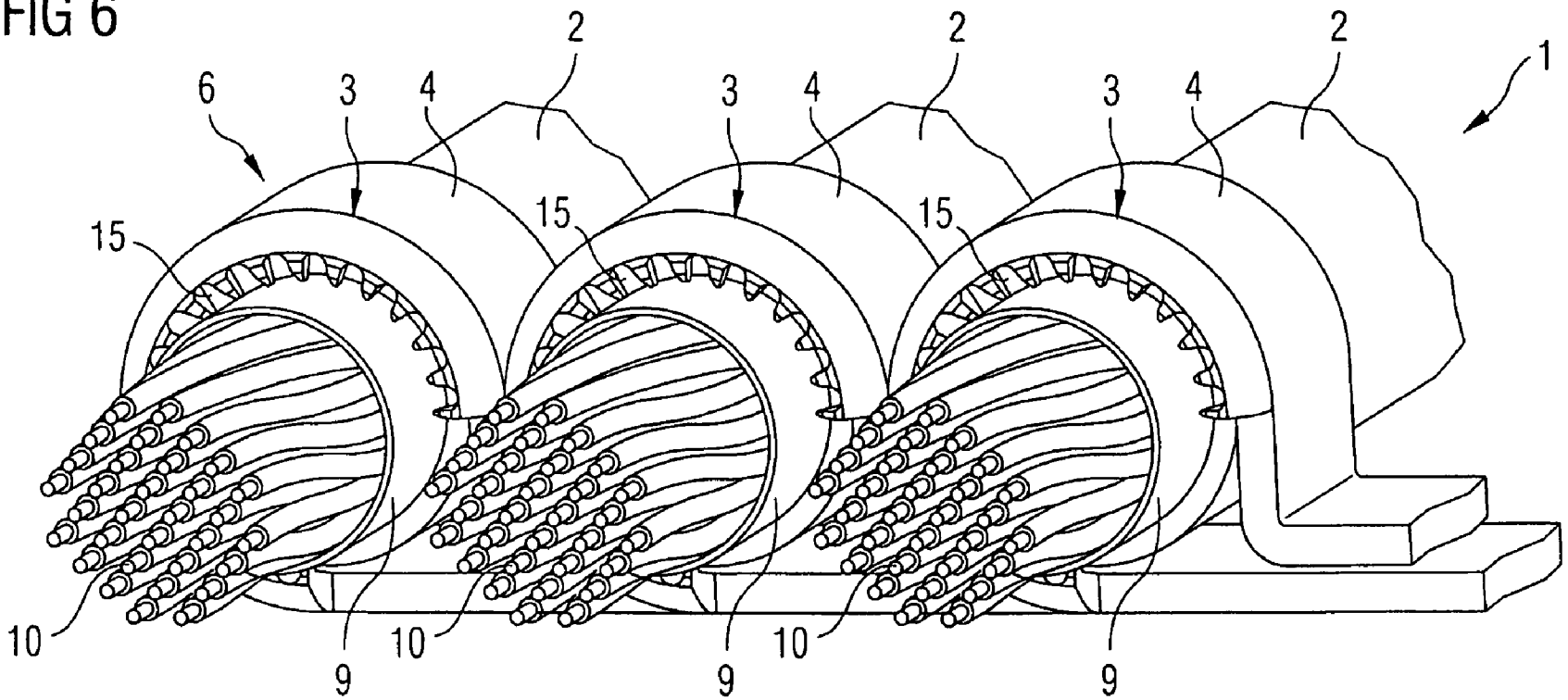
FIG. 6 shows a perspective view of a second embodiment of the invention as a clamp for a plurality of cables.

Technically, the basic principle of a contact device described above can be used for an arrangement with a plurality of cables. FIG. 6 shows this in a second embodiment as a multi-cable clamp. The contact part 3 has for example three arc-shaped contact sections 4 which each clamp an electrical cable 2. This multi-cable clamp can be fixed to a plate using bolt fixings as described above.

| Reference list | |
|---|---|
| 1 | Contact equipment |
| 2 | Electrical cable |
| 3 | Contact part |
| 4 | Arc-shaped section |
| 5 | Contact element |
| 6 | Cable clip |
| 7 | Clamp |
| 8 | Cable sheath |
| 9 | Cable shield |
| 10 | Single cores |
| 11 | Plate |
| 12 | Tooth |
| 13 | Point |
| 14 | Surface |
| 15 | Tooth ring |
| 16 | Contact point |
| 17 | Base |
| 18 | Stop |
| H | Tooth height |
| DM | Sheath thickness |
| DS | Shield thickness |
| D | Overall thickness |

The invention claimed is:

1. A contact device for an electrical cable with a cable shield within a cable sheath, comprising:

an arc-shaped contact part that can be fastened around the sheath of the cable and is provided with contact elements that protrude in a radially inward manner, wherein each contact element includes a tip to penetrate the cable sheath and produces an electrical contact with the cable shield, wherein after installation, each contact element is arranged in a direction of impact that is oriented inwards in a substantially radial manner, wherein the contact part is formed as a cable clip, wherein a gear ring is formed from radially inward bent edges of the cable clip, wherein teeth of the gear ring form the contact elements, wherein the gear ring has a plurality of rigid stops bent radially inward between the teeth, the stops centering the cable when the cable clip is in a fastened state and the stops prevent further penetration of the contact part into the cable when the stops contact the cable during installation.

2. The contact device according to claim 1, wherein the teeth of the fastened contact clip penetrate the cable sheath such that an electrical contact is provided in an essentially concentric area with respect to the longitudinal axis of the cable.

3. The contact device according to claim 1, wherein the cable clip is made from a punched and shaped component of sheet metal section.

4. The contact device according to claim 2, wherein the cable clip is made from a punched and shaped component of sheet metal section.

5. The contact device according to claim 1, wherein the teeth are triangular shaped and the tips are arranged at equal distances apart.

6. The contact device according to claim 1, wherein each tooth has a tooth height that is smaller than or equal to an overall thickness, wherein the overall thickness comprises the thickness of the cable sheath and the thickness of the cable shield.

7. The contact device according to claim 2, wherein each tooth has a tooth height that is smaller than or equal to an overall thickness, wherein the overall thickness comprises the thickness of the cable sheath and the thickness of the cable shield.

8. The contact device according to claim 1, wherein the teeth are arranged on the peripheral side over gaps.

9. The contact device according to claim 2, wherein the teeth are arranged on the peripheral side over gaps.

10. The contact device according to claim 1, wherein contact part and all the teeth are made from one piece and from the same metallic material.

11. The contact device according to claim 1, wherein the contact part is manufactured from a corrosion-resistant material.

12. The contact device according to claim 1, wherein the contact part is fastened to a board of an electrical device using a bolted connection and the cable shield is electrically connected to the ground potential of the board by the contact part.

13. A contact device for an electrical cable with a cable shield within a cable sheath, comprising:

a substantially-flat base portion having a bolt fixing;

a rigid arc-shaped contact part connected to the base portion, the contact part for fastening around a sheath of the cable and having contact elements that protrude radially inward;

wherein each contact element includes a tip such that during installation the tip penetrates the cable sheath and produces an electrical contact with the cable shield, wherein each tip is equally spaced from adjacent tips, wherein the contact part is formed as a cable clip, wherein a gear ring is formed from radially inward bent edges of the cable clip, wherein teeth of the gear ring form the contact elements, wherein the gear ring has a plurality of rigid stops bent radially inward between the teeth, the stops centering the cable when the cable clip is in a fastened state.

14. The contact device according to claim 13, wherein the stops prevent further penetration of the contact part into the cable when the stops contact the cable during installation.

15. The contact device according to claim 13, wherein after installation, each contact element is arranged in a direction of impact that is oriented inwards in a substantially radial manner.

16. The contact device according to claim 13, wherein the cable clip is made from a punched and shaped component of sheet metal section.

* * * * *